United States Patent [19]

Yoshioka

[11] Patent Number: 4,457,141

[45] Date of Patent: Jul. 3, 1984

[54] CATALYTIC CONVERTER FOR TREATING EXHAUST GASES

[75] Inventor: Hachiro Yoshioka, Yokohama, Japan

[73] Assignee: Nissan Motor Company, Limited, Kanagawa, Japan

[21] Appl. No.: 367,224

[22] Filed: Apr. 9, 1982

[30] Foreign Application Priority Data

Apr. 10, 1981 [JP] Japan ..... 56-53161

[51] Int. Cl.[3] ..... F01N 3/28

[52] U.S. Cl. ..... 60/299; 60/302; 422/180

[58] Field of Search ..... 60/302, 299; 422/180

[56] References Cited

U.S. PATENT DOCUMENTS

| | | | |
|---|---|---|---|
| 4,180,544 | 12/1979 | Santiago | 422/180 |
| 4,282,186 | 8/1981 | Nonnenmann | 422/180 |
| 4,385,032 | 5/1983 | Fratzer | 422/180 |

FOREIGN PATENT DOCUMENTS

| | | | |
|---|---|---|---|
| 3010633 | 9/1981 | Fed. Rep. of Germany | 422/180 |
| 51-13611 | 4/1976 | Japan . | |
| 52-13021 | 2/1977 | Japan | 60/302 |
| 53-32223 | 3/1978 | Japan | 60/302 |
| 54-71769 | 6/1979 | Japan | 422/180 |
| 55-146217 | 11/1980 | Japan | 422/180 |
| 1602991 | 11/1981 | United Kingdom | 422/180 |

*Primary Examiner*—Douglas Hart

*Attorney, Agent, or Firm*—Lowe, King, Price & Becker

[57] ABSTRACT

A catalytic converter for treating exhaust gases includes a carrier and a casing. The carrier has an axis with respect to its contour and is of honeycomb structure. The carrier is made of metal and has catalyst on its surfaces. The casing houses the carrier. The casing is made of metal having a coefficient of thermal expansion relatively close to that of the metal constituting the carrier. The carrier has a tapered outer-surface which is oblique with respect to the axis of the carrier. The casing has a tapered inner-surface which matches the tapered surface of the carrier. The tapered surfaces of the carrier and the casing are substantially in contact with each other so that the casing may axially secure the carrier.

3 Claims, 1 Drawing Figure

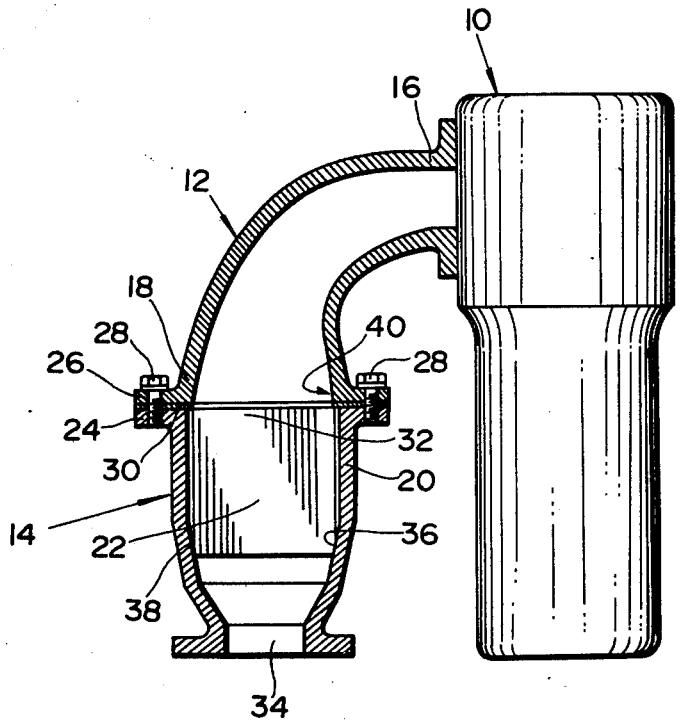
10
16
12
18
28
26
24
30
14
22
38
34
40
28
32
20
36

CATALYTIC CONVERTER FOR TREATING EXHAUST GASES

BACKGROUND OF THE INVENTION

1. Field of the Invention

This invention relates to a catalytic converter for treating exhaust gases which employs a monolithic carrier for the catalyst.

2. Description of the Prior Art

It is well-known to equip an automotive vehicle with a catalytic converter to treat engine exhaust gases for the purpose of emission control. Some kinds of converters employ a monolithic catalyst-carrier of honeycomb construction. There have been developments that utilize metal as a material for such a honeycomb carrier.

SUMMARY OF THE INVENTION

It is an object of the present invention to provide a catalytic converter with a catalyst honeycomb-carrier of metal which is of simple structure.

Another object of the present invention is to provide a catalytic converter with a catalyst honeycomb-carrier of metal which securely supports the carrier even under a wide range of temperatures.

In accordance with the present invention, a catalytic converter for treating exhaust gases includes a carrier and a casing. The carrier has an axis with respect to its contour and is of honeycomb structure. The carrier is made of metal and has catalyst on its surfaces. The casing houses the carrier. The casing is made of metal having a coefficient of thermal expansion relatively close to that of the metal constituting the carrier. The carrier has a tapered outer-surface which is oblique with respect to the axis of the carrier. The casing has a tapered inner-surface which matches the tapered surface of the carrier. The tapered surfaces of the carrier and the casing are substantially in contact with each other so that the casing may axially secure the carrier.

The above and other objects, features and advantages of the present invention will be apparent from the following description of a preferred embodiment thereof, taken in conjunction with the drawing.

BRIEF DESCRIPTION OF THE DRAWING

The drawing is a longitudinal section view of an engine exhaust manifold and its periphery including a catalytic converter of the present invention.

DESCRIPTION OF THE PREFERRED EMBODIMENT

With reference to the drawing, there is shown an automotive internal combustion engine, which includes an engine body 10, an exhaust manifold 12, and a catalytic converter 14 of the present invention. Normally, the branches 16 (only one is shown) of the exhaust manifold 12 are connected to the engine body 10, and the common end 18 thereof is directed downwards and is connected to the catalytic converter 14. The exhaust gases are conducted from the engine body 10 to the catalystic converter 14 through the exhaust manifold 12, and then pass through the catalytic converter 14 before being discharged to the atmosphere. The catalytic converter 14 treats the exhaust gases to convert gaseous pollutants, such as HC (hydrocarbon), CO (carbon monoxide), and/or $NO_x$ (nitrogen oxides) into harmless gases, such as $H_2O$ (water), $CO_2$ (carbon dioxide), $N_2$ (nitrogen), and/or $O_2$ (oxygen).

The catalytic converter 14 includes a hollow cylindrical casing 20 and a monolithic carrier 22 of columnar contour and of honeycomb cross-section. Thus, each cell of the carrier 22 extends parallel to the axis of the casing 20 to form an axially-extending passage. In other words, the carrier 22 is of honeycomb structure and has therethrough a plurality of axially-extending internal passages of hexagonal cross-section. The carrier 22 has catalyst on its surfaces in such a conventional manner as to constitute a substrate for the catalyst and is housed coaxially within the casing 20. The casing 20 is so located that its axis will be vertical. One end of the casing 20 is provided with a flange 24 around its periphery which matches a flange 26 at the downstream end 18 of the exhaust manifold 12. These flanges 24 and 26 are bolted together at 28 to coaxially connect the catalytic converter 14 to the exhaust manifold 12. An annular gasket 30 is coaxially provided for sealing between the flanges 24 and 26. The ends of the casing 20 near and remote from the exhaust manifold 12 constitute the inlet 32 and the outlet 34 of the catalytic converter 14 respectively. The exhaust gases enter the catalytic converter 14 via the inlet 32, pass through the carrier 22 to be treated and then exit via the outlet 34.

The outside diameter of the carrier 22 is essentially equal to or slightly smaller than the inside diameter of the casing 20 so as to snugly fit into the casing 20. The inner-surface of the casing 20 near the outlet 34 has an axial taper 36 in such a manner that the inside diameter of the casing 20 decreases in the axial direction from the inlet 32 to the outlet 34. In other words, the casing 20 has a tapered inner-surface 36 which is oblique with respect to the axis of the casing 20. The peripheral surface of one end of the carrier 22 tapers axially in such a manner that starting at a point near the end face of the carrier 22, the outside diameter of the carrier 22 gradually decreases in a minimum at the end face, in the axial direction. In other words, the carrier 22 has, at its end, a tapered peripheral-surface 38 which is oblique with respect to the axis of the carrier 22. The tapered inner-surface 36 of the casing 20 matches the tapered peripheral-surface 38 of the carrier 22. The inside diameter of the downstream end 18 of exhaust manifold 12 is smaller than the inside diameter of the inlet 32 of casing 20. The inside diameter of the gasket 30 is equal to that of the downstream end 18 of exhaust manifold 12. Therefore, the gasket 30 and the downstream end 18 of exhaust manifold 12 constitute an annular inside step 40 at the seam between the exhaust manifold 12 and the casing 20.

During assembly, the carrier 22 is inserted into the casing 20 through the inlet 32 until its tapered surface 38 comes into contact with the tapered surface 36 of the casing 20. The matched tapered-surfaces 36 and 38 ensure sealing contact therebetween and thus reduction in the amount of exhaust gases bypassing the carrier 22 through undesirable gaps therebetween. The tapered structure thus reduces the amount of non-treated gases discharged to the atmosphere. After the insertion of the carrier 22 into the casing 20, the casing 20 is attached to the exhaust manifold 12.

The outside diameter of the non-tapered end of carrier 22 is larger than the minimum inside diameter of the step 40, so that the step 40 limits the axial movement of the carrier 22. The tapered surface 36 of the casing 20 limits the opposite axial movement of the carrier 22.

Thus, the step 40 and the tapered surface 36 of the casing 20 cooperate to limit both axial movements of the carrier 22. The length of the carrier 22 is preferably chosen so that the carrier 22 will be firmly held between the step 40 and the tapered surface 36 of the casing 20. In this case, the step 40 and the carrier 22 are substantially in contact with each other while the tapered surfaces 36 and 38 of the casing 20 and the carrier 22 are substantially in contact with each other. This firm support of the carrier 22 is especially important in the case of an automotive catalytic converter, because it is subjected to intense vibration.

The casing 20 is made of metal, such as iron which has a coefficient of thermal expansion of about $14\times10^{-6}$ (1/°C.). The carrier 22 is also made of metal. To limit undesirable gaps between the casing 20 and the carrier 22 acceptably without excessively forceful contact therebetween over a wide temperature range, the metal of the casing 20 should be chosen to have a coefficient of thermal expansion relatively close to that of the metal constituting the carrier 22. The ratio of the thermal expansion coefficient of the metal constituting the carrier 22 to that to the metal constituting the casing 20 is preferably 1:06~1:1.2. Since the carrier 22 becomes somewhat hotter than the casing 20 during normal operating conditions of the catalytic converter 14, the thermal expansion coefficient of the metal of carrier 22 is, most preferably, slightly smaller than that of the metal constituting the casing 20. For example, the carrier 22 can be a carrier article which has been developed by Johnson Mathey and Co., Ltd. (J.M.C. Great Britain). The material of the article contains iron as a base, 15–20% chromium, 4–5% aluminum, and 0.1–0.3% yttrium and has a coefficient of thermal expansion of about $13\times10^{-6}$ (1/°C.). Since the difference between the coefficients of thermal expansion of the casing 20 and the carrier 22 is thus relatively small, undesirable gaps therebetween can be kept extremely small, possibly less than 1.0 mm, over a wide temperature range. The limitation of these gaps results in a reduction in the amount of exhaust gases passing therethrough and thus in an increase in the amount of exhaust gases traveling through the carrier 22 to be treated. Since the carrier 22 is made of metal, the carrier 22 will deform to reduce the stresses thereon and prevent breakage thereof if the carrier 22 expands beyond the size of the interior of the casing 20.

It should be understood that further modifications and variations may be made in the present invention without departing from the spirit and scope of the present invention. For example, a thin sealing-ring may be provided between the matched tapered-surfaces 36 and 38 of the casing 20 and the carrier 22 to more effectively reduce the amount of exhaust gases flowing through the undesirable gaps between the casing 20 and the carrier 22.

What is claimed is:

1. A catalytic converter for treating exhaust gases, comprising:

(a) an exhaust manifold having a downstream end via which exhaust gases can exit from the exhaust manifold;

(b) a casing having an upper end and a lower part spaced from each other in a vertical direction, the casing having a hollow extending therethrough between the upper end and the lower part thereof, the upper end of the casing being positioned immediately below and in air communication with the downstream end of the exhaust manifold so that exhaust gases can enter the casing from the exhaust manifold;

(c) means for fixing the casing to the exhaust manifold;

(d) a gasket positioned between the upper end of the casing and the downstream end of the exhaust manifold for providing an airtight seal with respect to the combination of the exhaust manifold and the casing;

(e) a catalyst;

(f) a carrier for carrying the catalyst thereon, the carrier having upper and lower ends spaced from each other in the vertical direction, the carrier having a plurality of passages extending therethrough between the upper and lower ends thereof, the carrier being positioned in the casing;

(g) the lower part of the casing having a tapered inner-surface, the lower end of the carrier having a tapered outer-surface matching the tapered inner-surface of the casing, the tapered outer-surface of the carrier being in contact with the tapered inner-surface of the casing;

(h) the downstream end of the exhaust manifold defining an inside step immediately above the upper end of the carrier;

(i) the gasket having a part extending between the step on the exhaust manifold and the upper end of the carrier;

(j) means for pressing the gasket against the upper end of the carrier via the step on the exhaust manifold and thereby urging the tapered outer-surface of the carrier against the tapered inner-surface of the casing, whereby the carrier is held at the upper and lower ends thereof by the casing and the exhaust manifold; and (k) the carrier being made of metal and the casing being made of metal having a coefficient of thermal expansion approximately equal to that of the metal forming the carrier.

2. A catalytic converter as recited in claim 1, wherein the ratio of the coefficient of thermal expansion of the carrier metal to that of the casing metal is 1:0.6~1:1.2.

3. A catalytic converter as recited in claim 1, wherein the coefficient of thermal expansion of the carrier metal is slightly smaller than that of the casing metal.

* * * * *